US007082690B1

(12) United States Patent
Khoshnood

(10) Patent No.: US 7,082,690 B1
(45) Date of Patent: Aug. 1, 2006

(54) AMBIENT LIGHT COLLECTING SIGHT PIN FOR A BOW SIGHT

(76) Inventor: Bahram Khoshnood, 2735 Two Rock Ct., Alpharetta, GA (US) 30004

( * ) Notice: Subject to any disclaimer, the term of this patent is extended or adjusted under 35 U.S.C. 154(b) by 0 days.

(21) Appl. No.: 11/034,462

(22) Filed: Jan. 13, 2005

(51) Int. Cl.
*F41G 1/467* (2006.01)

(52) U.S. Cl. ..... 33/265; 124/87

(58) Field of Classification Search ..... 33/265; 124/87
See application file for complete search history.

(56) References Cited

U.S. PATENT DOCUMENTS

| | | | | |
|---|---|---|---|---|
| 3,997,974 | A | 12/1976 | Larson | |
| 4,177,572 | A | 12/1979 | Hindes | |
| 4,220,983 | A | 9/1980 | Schroeder | |
| 4,535,544 | A | 8/1985 | Jones et al. | |
| 4,875,144 | A | 10/1989 | Wainwright | |
| 4,977,677 | A | 12/1990 | Troescher, Jr. | |
| 5,121,547 | A | 6/1992 | Littlejohn | |
| 5,168,631 | A | 12/1992 | Sherman | |
| 5,174,269 | A | 12/1992 | Sappington | |
| 5,231,765 | A | 8/1993 | Sherman | |
| 5,253,423 | A | 10/1993 | Sullivan, Jr. et al. | |
| 5,255,440 | A | 10/1993 | Rogers | |
| 5,341,791 | A | 8/1994 | Shafer | |
| 5,442,861 | A | 8/1995 | Lorocco | |
| 5,560,113 | A | 10/1996 | Simo et al. | |
| 5,579,033 | A | 11/1996 | Rutledge et al. | |
| 5,634,278 | A | 6/1997 | London | |
| 5,649,526 | A | 7/1997 | Ellig | |
| 5,671,724 | A | 9/1997 | Priebe | |
| 5,791,060 | A | 8/1998 | Godsey | |
| 5,850,700 | A | 12/1998 | Capson et al. | |
| 5,862,603 | A | 1/1999 | Ellig | |
| 5,924,234 | A * | 7/1999 | Bindon et al. | 42/123 |
| 5,956,854 | A | 9/1999 | Lorocco | |
| 5,975,069 | A | 11/1999 | Hamm et al. | |
| 5,996,569 | A | 12/1999 | Wilson | |
| 6,000,141 | A | 12/1999 | Afshari | |
| 6,016,608 | A | 1/2000 | Lorocco | |
| 6,073,352 | A | 6/2000 | Zykan et al. | |
| 6,199,286 | B1 | 3/2001 | Reed, Jr. et al. | |
| 6,247,237 | B1 * | 6/2001 | Redburn et al. | 33/265 |
| 6,311,405 | B1 | 11/2001 | Slates | |
| 6,418,633 | B1 | 7/2002 | Rager | |
| 6,601,308 | B1 | 8/2003 | Khoshnood | |
| 6,725,854 | B1 * | 4/2004 | Afshari | 124/87 |
| 6,807,742 | B1 * | 10/2004 | Schick et al. | 33/297 |
| 6,938,349 | B1 * | 9/2005 | Afshari | 33/265 |
| 2005/0138824 | A1 * | 6/2005 | Afshari | 33/265 |

OTHER PUBLICATIONS

Cobra Bowhunting Products, "2003 Product Catalog", Cobra Manufacturing Co., Inc., Bixby, OK.

(Continued)

*Primary Examiner*—Diego Gutierrez
*Assistant Examiner*—Amy R. Cohen
(74) *Attorney, Agent, or Firm*—Ashish D. Patel, Esq.; Joel D. Myers, Esq.; Myers & Kaplan, LLC

(57) ABSTRACT

Ambient light collecting sight pins for a bow sight, wherein the sight pins comprise coiled fiber optic filaments for effectively harnessing diminutive amounts of ambient light and magnifying same to a useable light source capable of assisting hunters in sighting their targets in low-light environments.

16 Claims, 4 Drawing Sheets

OTHER PUBLICATIONS

Trophy Ridge, "2003 Catalog", Trophy Ridge, LLC, Belgrade, MT.
TRUGLO, "2003 Catalog", TRUGLO, Inc., McKinney, TX.
TRUGLO, "2001 Catalog", TRUGLO, Inc., McKinney, TX.
ARROWTRADE (magazine), "Bow Tech" Jan. (2004), p. 4, ARROWTRADE, Braham, MN.
Inside Archery (magazine), "Vital Bow Gear", Jun. (2004), p. 61.
BOWHUNTING, "bowhuntingmag.com", Sep. (2004).
Vital Bow Gear, "http://www.vitalbowgear.com/tombstone.cfm".

* cited by examiner

AMBIENT LIGHT COLLECTING SIGHT PIN FOR A BOW SIGHT

TECHNICAL FIELD

The present invention relates generally to bow sights, and more specifically to an ambient light collecting sight pin for a bow sight. The present invention is particularly useful in, although not limited to, assisting hunters and/or competition shooters equipped with bows and/or firearms to target game or objects in low-light environments.

BACKGROUND OF THE INVENTION

Effective and successful use of a bow is dependent upon a multitude of variables, including establishment of proper trajectory, string tension, drawback and even the weight of the bow. More importantly, however, the precision of a bowshot is largely dependent upon proper targeting or aiming and the ability to sight one's target. As such, many archers/hunters have employed the use of bow sights to assist in such targeting. Unfortunately, however, because most hunting expeditions are usually conducted in low-level light conditions/environments, such as a dense forest, most conventionally available bow sights are unable to effectively assist the hunter in sighting his target.

Although attempts have been made to cure the deficiencies and inadequacies of conventional sighting pins and/or crosshairs, simple bow sights of this sort are of limited use because they fail to provide the archer/hunter with the requisite amount of light needed to sight a target within the bow sight. Furthermore, while bow sights with small light collecting filaments are known, they too serve limited use as they are typically unable to harness enough ambient light to make use of the bow sight worthwhile.

Therefore, it is readily apparent that there is a need for an ambient light collecting sight pin for a bow sight, wherein the present invention effectively harnesses diminutive amounts of ambient light and magnifies same to a useable light source capable of assisting hunters in sighting their targets in low-light environments.

BRIEF SUMMARY OF THE INVENTION

Briefly described, in a preferred embodiment, the present invention overcomes the above-mentioned disadvantage, and meets the recognized need for such a device by providing ambient light collecting sight pins for a bow sight, wherein the sight pins comprise coiled fiber optic filaments for effectively harnessing diminutive amounts of ambient light and magnifying same to a useable light source capable of assisting hunters in sighting their targets in low-light environments.

According to its major aspects and broadly stated, the present invention in its preferred form is an ambient light collecting sight pin for a bow sight, wherein the sight pin generally comprises a light collecting filament and a translucent spool or housing integrally formed with, or otherwise adapted to, the sight pin.

More specifically, the present invention is an ambient light collecting sight pin for a bow sight, comprising a light collecting filament preferably in the form of a scintillating fiber optic filament of sufficient length to enable extensive wrapping or winding of the filament around or within a preferably translucent spool or housing, wherein the spool or housing is preferably integrally formed with, or otherwise adapted to, the sight pin. Moreover, a portion of the fiber optic filament retained on or within the spool or housing is guided around and removably secured to the sight pin, such that the terminal end of the filament resides at the tip of the sight pin.

Preferably, the repeated wrapping or winding of the lengthy strand of fiber optic filament configures the filament to provide an enhanced surface area over which to harness ambient light. The translucent material from which the spool or housing is constructed further enables ambient light to pass therethrough, and thus be harnessed by the wrapped filament. Accordingly, the terminal end of the portion of filament removably secured to the tip of the sight pin is preferably illuminated as a result of the harnessed ambient light.

In use, a plurality of such lit sight pins, each having filaments of differing color, may be removable secured to a bow sight generally adapted to receive sight pins. Additionally, the bow sight may be constructed from a translucent material to assist in the overall light-harnessing process of each fiber optic filament.

Accordingly, a feature and advantage of the present invention is its ability to provide a bow sight having interchangeable, light-harnessing sight pins.

Another feature and advantage of the present invention is its ability to be utilized in extremely low-level light environments.

Still another feature and advantage of the present invention is its ability to effectively harness ambient low-level light and magnify it to a useable light source.

Yet another feature and advantage of the present invention is its ability to allow the archer/hunter to sight targets in low-level light environments.

Still yet another feature and advantage of the present invention is its ability to provide a large, multi-coiled ambient light collecting surface area.

These and other features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

In describing the preferred and alternate embodiments of the present invention, as illustrated in FIGS. 1–4, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
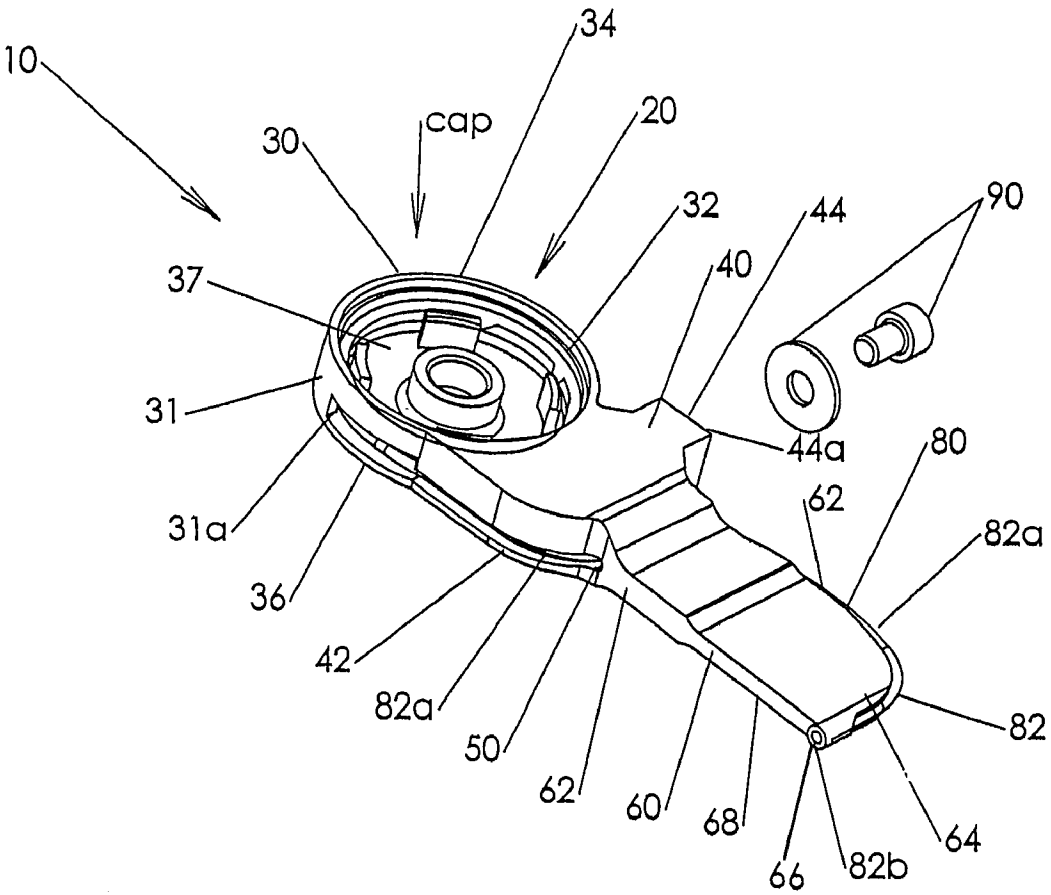
FIG. 1 is a perspective view of an ambient light collecting sight pin according to a preferred embodiment of the present invention.
Figure 2:
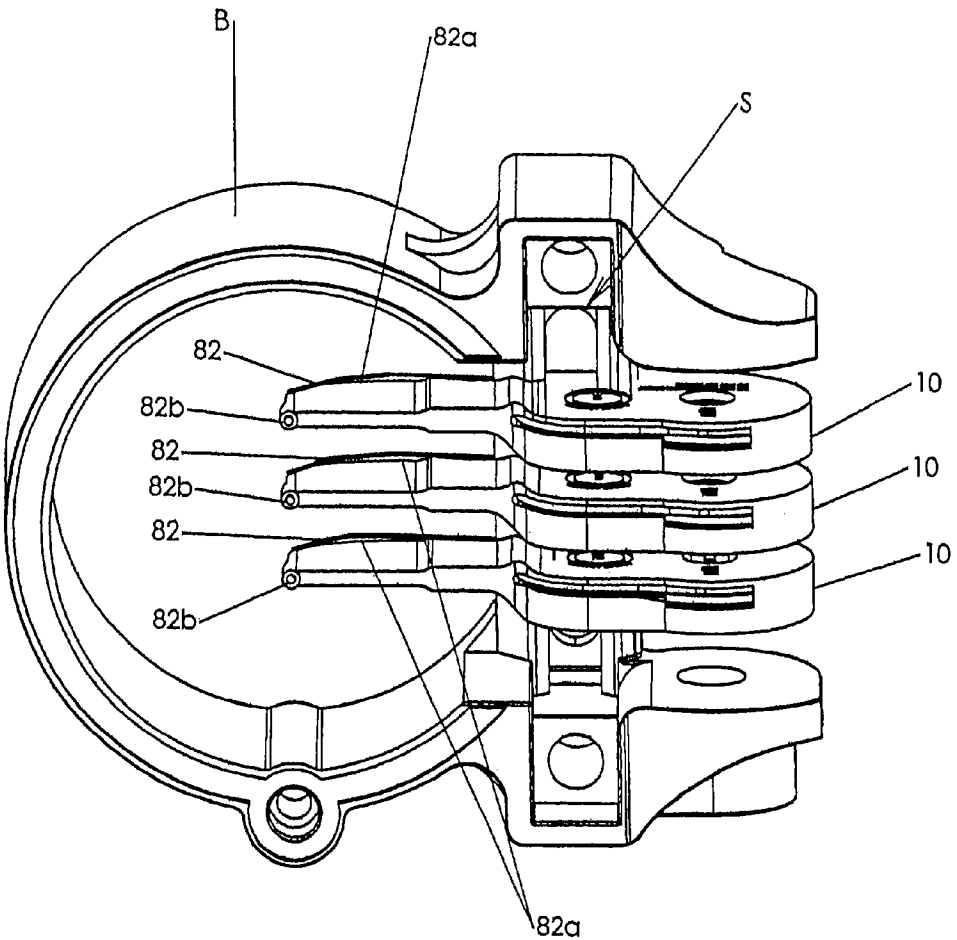
FIG. 2 is a perspective view of an ambient light collecting sight pin according to a preferred embodiment of the present invention, shown in use.

Referring now to FIGS. 1–2, the present invention in its preferred embodiment is an ambient light collecting sight pin 10 generally comprising body 20 and light collecting mechanism 80.

Specifically, body 20 preferably comprises integrally formed housing 30, medial portion 40 and pin shaft 60, wherein body 20 is generally preferably formed from a translucent acrylic substrate, so as to enable ambient light to pass therethrough, and thus be harnessed by light collecting mechanism 80, as more fully described below. Additionally, and as further described below, housing 30 is preferably substantially cylindrical-shaped so as to facilitate the multiple coiling or windings of light collecting mechanism 80 therewithin; thereby, promoting a greater surface area in which to capture ambient light passing through housing 30. Although body 20 is formed from a translucent acrylic substrate, it should be recognized that other suitable translucent plastic substrates may be utilized.

Light collecting mechanism 80 is preferably a substantially long strand of scintillating ambient light collecting fiber optic filament 82, preferably substantially wrapped a plurality of times around the circumference of inner wall 32 of housing 30, wherein housing 30 preferably comprises peripheral retaining lips 34, 36 and floor 37 to prevent coiled fiber optic filament 82 from dislodging or sliding out from housing 30.

Preferably formed through peripheral wall 31 of housing 30 is aperture 31*a*, wherein leading end 82*a* of fiber optic filament 82 preferably extends therethrough and tensionally over forward wall 42 of medial portion 40. Thereafter, leading end 82*a* of fiber optic filament 82 preferably extends and exists through channel 50, preferably formed through forward wall 42 of medial portion 40 and exiting from rear wall 44 thereof, and further residing substantially proximal to base 62 of pin shaft 60. Accordingly, following exit through rear wall 44 of medial portion 40, leading end 82*a* of fiber optic filament 82 preferably tensionally extends over rear edge 62 of generally blade-like or plate-like pin shaft 60, and continues over upper edge or apex 64 of pin shaft 60, wherein terminal end 82*b* of leading end 82*a* of fiber optic filament 82 is preferably inserted through and removably secured within retaining tube 66 disposed atop apex 64 and proximal to forward edge 68 of pin shaft 60.

Preferably, the plurality of coils and/or wrappings of fiber optic filament 82 within housing 30 promote a greater surface area in which to capture ambient light passing through housing 30, or directly striking fiber optic filament 82. Additionally, leading end 82*a* of fiber optic filament 82 further assists in capturing ambient light and contributing to the overall light harnessing process of the preset invention. As such, light from all directions is generally harnessed by fiber optic filament 82, thus increasing, magnifying and generally enhancing the output of useful light from terminal end 82*b* of light collecting mechanism 80.

As best illustrated in FIG. 2, in use, a plurality of sight pins 10, each having fiber optic filaments 82 of differing color, may be removable secured to, and slidably adjusted within, sight pin retaining slot S formed on bow sight/scope B generally adapted to receive sight pins 10, wherein each sight pin 10 may be secured to slot S of bow sight B via application of set screw or bolt-and-washer assembly 90 adapted to be threadably received by threaded hole 44*a* formed on rear wall 44 of medial portion 40 of sight pin 10. In such an arrangement, a plurality of lit terminal ends 82*b* of filaments 82 function as lit sight pins 10. It is contemplated that bow sight B may be constructed from a translucent material to assist in the overall light-harnessing process of each fiber optic filament 82.

Figure 3:
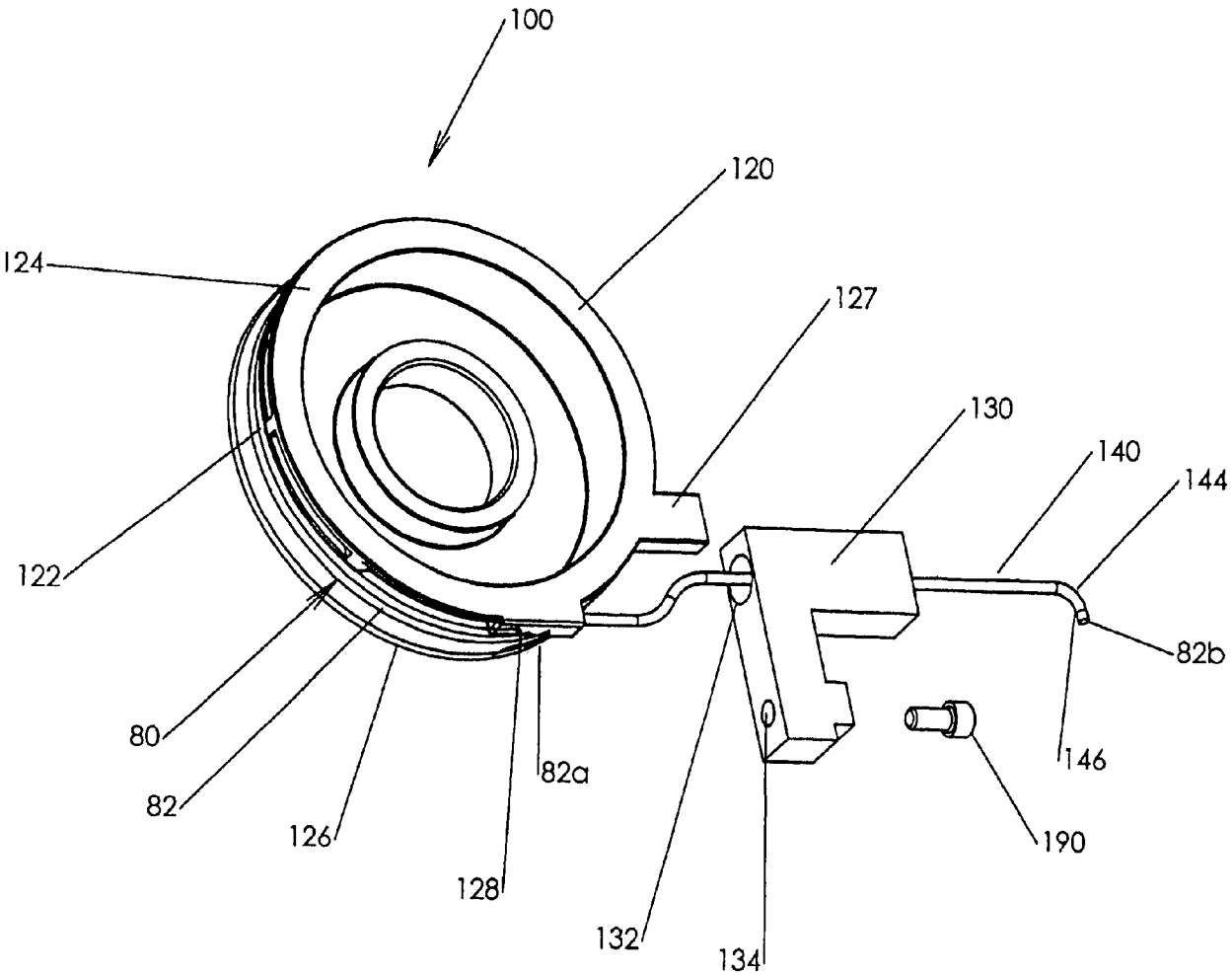
FIG. 3 is a perspective view of an ambient light collecting sight pin according to an alternate embodiment of the present invention; and, FIG. 4 is a perspective view of an ambient light collecting sight pin according to an alternate embodiment of the present invention, shown in use.
Figure 4:
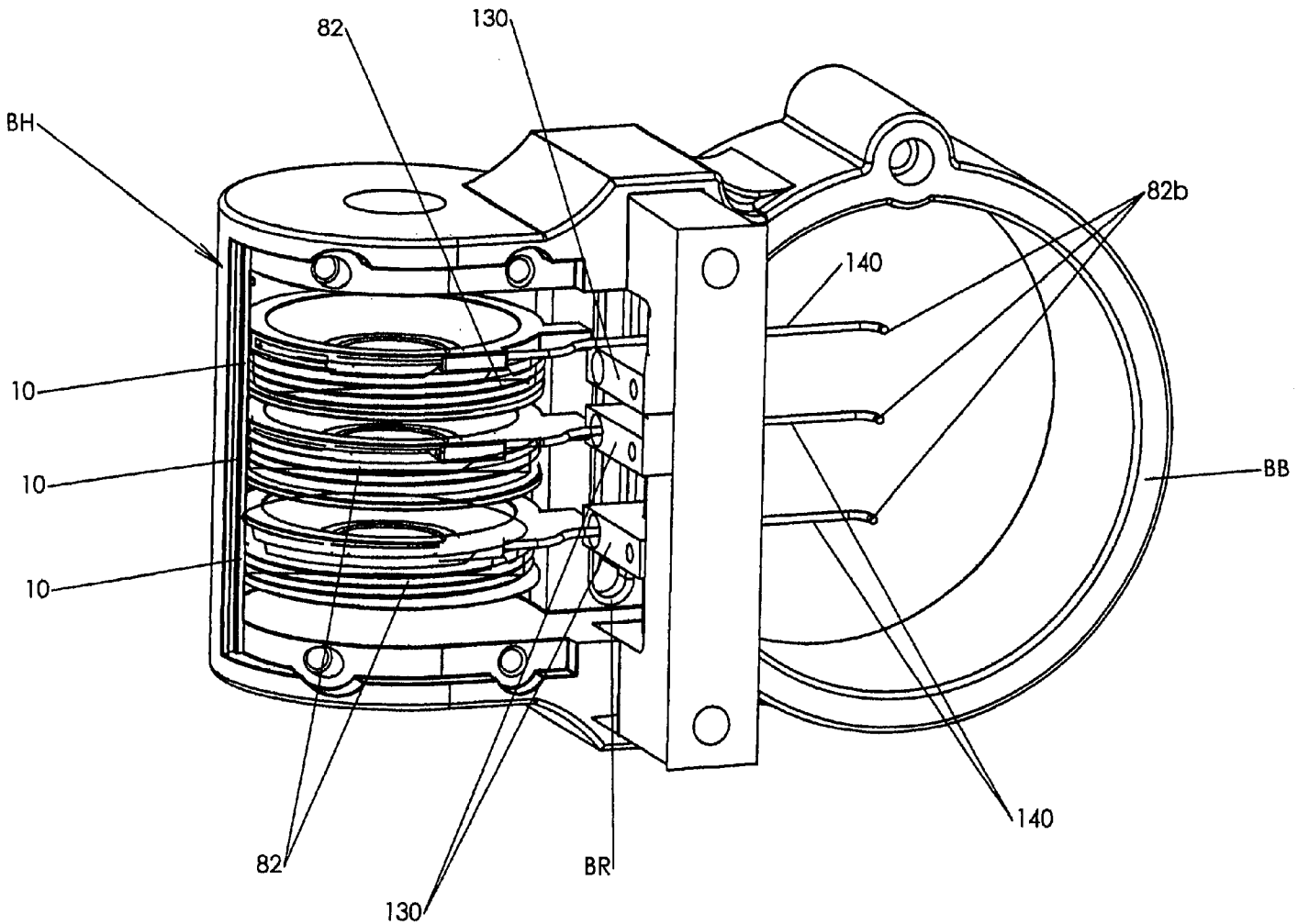

Referring now more specifically to FIGS. 3–4, the present invention in an alternate embodiment is an ambient light collecting sight pin 100 comprising light collecting mechanism 80, spool 120, pin base 130, and pin shaft 140.

Specifically, spool 120 is generally formed from a translucent acrylic substrate, so as to enable ambient light to pass therethrough, and thus be harnessed by light collecting mechanism 80. Light collecting mechanism 80 is a substantially long strand of scintillating ambient light collecting fiber optic filament 82, substantially wrapped a plurality of times around the outer circumference of spool stem 122 of spool 120, wherein spool 120 comprises exterior retaining plates 124, 126 integrally formed with spool stem 122, each comprising a diameter dimensionally larger than spool stem 122; thereby, preventing coiled fiber optic filament 82 from dislodging or sliding off from spool stem 122.

Formed on exterior retaining plate 124 is retaining tube 128, wherein leading end 82*a* of fiber optic filament 82 is inserted and extended therethrough. Thereafter, leading end 82*a* of fiber optic filament 80 is extended through channel 132 formed through substantially L-shaped base 130, wherein channel 132 is in communication with hollow, tube-like pin shaft 140, securely affixed to base 130. Accordingly, leading end 82*a* of fiber optic filament 82 extends through pin shaft 140 and through arcuate-shaped head 144 thereof, wherein terminal end 82*b* of leading end 82*a* of fiber optic filament 82 is brought flush with aperture 146 of pin shaft 144.

Accordingly, the plurality of coils and/or wrappings of fiber optic filament 82 around spool stem 122 promote a greater surface area in which to capture ambient light passing through spool 120, or directly striking fiber optic filament 82. Additionally, leading end 82*a* of fiber optic filament 82 further assists in capturing ambient light and contributing to the overall light harnessing process of the preset invention. As such, light from all directions is generally harnessed by fiber optic filament 82, thus increasing, magnifying and generally enhancing the output of useful light from terminal end 82*b* of light collecting mechanism 80.

As best illustrated in FIG. 4, in use, a plurality of sight pins 100, each having fiber optic filaments 82 of differing color, may be removable secured to, and slidably adjusted on, bracket BR of bow sight/scope BB generally adapted to receive sight pins 100, wherein each sight pin 100 may be secured to bracket BR of bow sight BB via application of set screw 190, or the like, adapted to be received by threaded throughhole 134 formed through base 130 of sight pin 100. Additionally, sight pin 100 may be secured to bow sight BB via securing tab 127 formed on retaining plate 124, wherein securing tab 127 could be received within a suitably dimensioned slot or groove formed within generally cylindrical-shaped bow housing BH integrally formed with bow sight/scope BB, or, alternatively, could be frictionally received therewithin. It is further contemplated that bow sight BB may also be constructed from a translucent material to assist in the overall light-harnessing process of each fiber optic filament 82.

It is contemplated in another alternate embodiment that a plurality of sight pins 10 or sight pins 100 may be integrally formed.

It is contemplated in still another alternate embodiment that fiber optic filaments 82 could be integrally formed with sight pins 10 or sight pins 100.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A sight pin for use with a bow sight, said sight pin comprising:

a body comprising a housing, a medial portion, and a pin shaft, wherein said housing, said medial portion, and said pin shaft are planarly aligned, and wherein a channel is formed through said medial portion of said body, proximal a base portion of said pin shaft; and, a light collecting mechanism carried by said body, wherein at least a portion of said light collecting mechanism is planarly aligned with said housing, said medial portion, and said pin shaft, and wherein at least a portion of said light collecting mechanism is coiled a plurality of revolutions.

2. The sight pin of claim 1, wherein at least a portion of said light collecting mechanism is coiled a plurality of revolutions within said housing of said body.

3. The sight pin of claim 1, wherein at least a portion of said light collecting mechanism is coiled a plurality of revolutions within said housing of said body, and wherein said at least a portion of said light collecting mechanism exits through an aperture formed through said housing.

4. The sight pin of claim 1, wherein at least a portion of said light collecting mechanism is disposed over said medial portion of said body.

5. The sight pin of claim 1, wherein at least a portion of said light collecting mechanism extends through said channel of said medial portion of said body.

6. The sight pin of claim 1, wherein at least a portion of said light collecting mechanism is disposed over said pin shaft of said body, and wherein at least a portion of said light collecting mechanism is removably secured within a retaining tube formed on said pin shaft.

7. The sight pin of claim 1, wherein at least a portion of said light collecting mechanism is coiled a plurality of revolutions within said housing, said at least a portion of said light collecting mechanism exiting through an aperture formed through said housing, said at least a portion of said light collecting mechanism extending from said aperture over said medial portion and extending through said channel of said medial portion, and wherein said at least a portion of said light collecting mechanism extending from said channel, further extends over said pin shaft and is removably secured within a retaining tube formed on said pin shaft.

8. The sight pin of claim 7, wherein said at least a portion of said light collecting mechanism extending from said aperture of said housing, over said medial portion and through said channel thereof, and thereafter over said pin shaft and removably secured within a retaining tube formed on said pin shaft, results in said at least a portion of said light collecting mechanism comprising a substantially S-shaped configuration.

9. The sight pin of claim 1, wherein said light collecting mechanism is a fiber optic filament.

10. A sight pin for use with a bow sight, said sight pin comprising:

a spool-shaped body;

a base, wherein said base resides independent of said spool-shaped body;

a pin shaft extending from said base, wherein said spool-shaped body, said base, and said pin shaft are planarly aligned; and, a light collecting mechanism carried by said spool-shaped body, wherein at least a portion of said light collecting mechanism is planarly aligned with said spool-shaped body, said base, and said pin shaft, and wherein at least a portion of said light collecting mechanism is coiled a plurality of revolutions.

11. The sight pin of claim 10, wherein at least a portion of said light collecting mechanism is coiled a plurality of revolutions around said spool-shaped body.

12. The sight pin of claim 10, wherein at least a portion of said light collecting mechanism extends through and is carried by a retaining tube, said retaining tube formed on said spool-shaped body.

13. The sight pin of claim 10, wherein at least a portion of said light collecting mechanism extends through a channel formed through said base.

14. The sight pin of claim 10, wherein at least a portion of said light collecting mechanism extends through said pin shaft, and wherein a terminal end of said at least a portion of said light collecting mechanism sits flush with a terminal aperture of said pin shaft.

15. The sight pin of claim 10, wherein at least a portion of said light collecting mechanism is coiled a plurality of revolutions around said spool-shaped body, and further extends through a retaining tube formed on said spool-shaped body, and wherein said at least a portion of said light collecting mechanism extends through a channel formed through said base and thereafter through said pin shaft, and wherein a terminal end of said at least a portion of said light collecting mechanism sits flush with a terminal aperture of said pin shaft.

16. The sight pin of claim 10, wherein said light collecting mechanism is a fiber optic filament.

* * * * *